United States Patent [19]

Cooke et al.

[11] 4,226,680

[45] Oct. 7, 1980

[54] PROCESS FOR ELECTROLYTIC COLORATION OF ANODIZED ALUMINIUM

[75] Inventors: William E. Cooke, Kingston; Robert A. Innes, Amherstview, both of Canada

[73] Assignee: Alcan Research and Development Limited, Montreal, Canada

[21] Appl. No.: 803,854

[22] Filed: Jun. 6, 1977

Related U.S. Application Data

[63] Continuation of Ser. No. 550,741, Feb. 18, 1975, abandoned.

[51] Int. Cl.[2] ..... C25D 11/22

[52] U.S. Cl. ..... 204/28; 204/35 N; 204/58; 204/DIG. 8; 204/DIG. 9; 204/228

[58] Field of Search ..... 204/DIG. 8, DIG. 9, 204/28, 35 N, 58, 228

[56] References Cited

U.S. PATENT DOCUMENTS 4,014,758 3/1977 Kawai et al. ..... 204/28

*Primary Examiner*—R. L. Andrews

*Attorney, Agent, or Firm*—Cooper, Dunham, Clark, Griffin & Moran

[57] ABSTRACT

A continuous length of aluminium is anodized during passage through an anodizing electrolyte and then colored during passage through an inorganic coloring electrolyte, in which a counterelectrode is immersed. In the electrolytic coloring stage alternating current with a superimposed D.C. compound is preferably passed between the anodized aluminium and the counterelectrode when the electrolyte is appropriate for such treatment. The alternating current circuit for the electrolytic coloring stage is preferably completed via an electrode immersed in the anodizing electrolyte at a position facing substantially unanodized aluminium so as to effect a liquid contact.

25 Claims, 5 Drawing Figures

PROCESS FOR ELECTROLYTIC COLORATION OF ANODIZED ALUMINIUM

Figure 1:
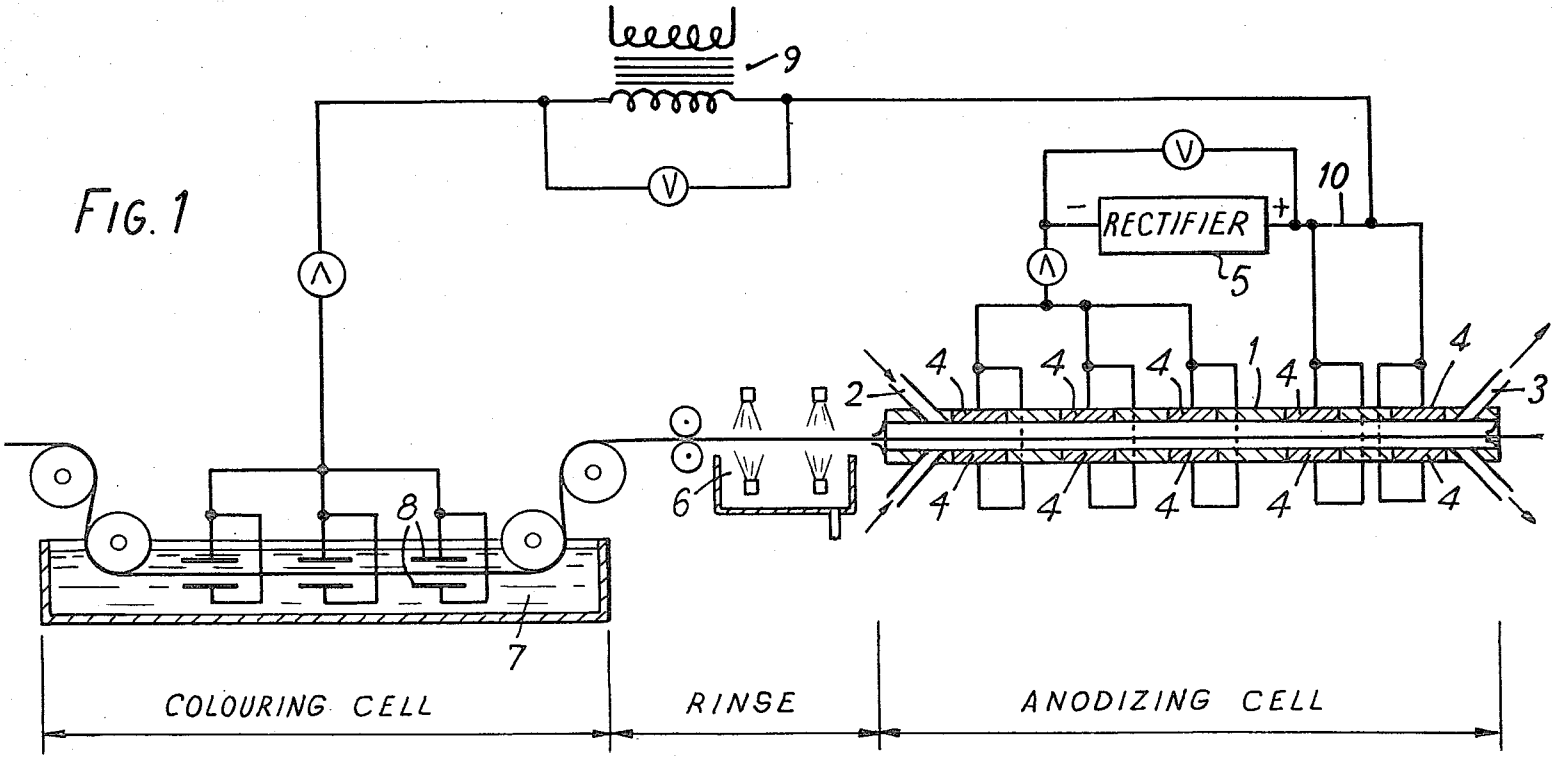

This is a continuation of applicaton Ser. No. 550,741, filed Feb. 18, 1975, now abandoned.

The present invention relates to colouring anodised aluminium by an alternating current electrolytic treatment and in particular to a procedure in which a continuous strip of coloured anodised aluminium may be produced.

It is well known that anodised aluminium may be coloured by the passage of alternating current between the anodised aluminium and a counterelectrode immersed in an electrolyte, containing certain metallic compounds. The electrolyte may contain salts of nickel, cobalt, copper, tin, chromium, silver, iron, lead or a manganate, selenite or tellurite and is maintained at an acid pH, dependent on the compound present in the bath. In some instances the bath contains salts of two or more metals, such as cobalt and nickel salts.

The operability of the process has always been explained on the assumption that, because of the blocking effect of the anodic oxide film, the total charge passing during the intervals when the aluminium is cathodic is greater than when the aluminium is anodic, so that the material deposited from the electrolyte during the cathodic intervals is greater than the amount redissolved during the anodic intervals. It has long been known that the passage of alternating current between anodised aluminium workpieces in these electrolytes leads at best to very faint colours, because in such circumstances the waveform of the current is symmetrical.

When it is desired to colour a moving strip of anodised aluminium by the alternating current process, it is obviously desirable that there should be no contact between the anodised aluminium and a stationary electrode. It is well known in the continuous anodisation of aluminium strip to employ the bipolar or "liquid contact" system. However, when that system is employed with an alternating current electrolytic colouring process, very little colour is produced. The almost total lack of colour is believed to be due to the symmetrical nature of the waveform resulting from passing alternating current from a first electrode through the electrolyte to the anodised aluminium and from the anodised aluminium through the electrolyte to a second electrode remote from the first electrode.

In order to overcome this difficulty, according to the present invention all the electrodes out of direct contact with the strip and facing an anodised surface in the electrolytic colouring stage are maintained at the same polarity. Where the strip is anodised on both surfaces the alternating current circuit is completed either by means of a mechanical contact located at a position in advance of the development of the anodic film or by means of a liquid contact at a position where the anodic film is at most only partly developed. It follows that, in this procedure, the colouring of the continuous strip is performed in line with the anodic oxidation stage.

Where the strip is anodised on one surface only, it is of course possible to complete the alternating current circuit by means of electrodes in direct contact with the unanodised surface of the strip or facing the unanodised surface, so that the electrolytic colouring may be performed in line with the anodic oxidation stage or, if desired, an already anodised continuous strip, anodised on one face only, may be coloured.

With certain colouring electrolytes, particularly Ni, Sn and Co salts, it has already been found beneficial to superimpose a D.C. component on the alternating current in batch processes for colouring anodised aluminium articles. With the above electrolytes it has been found that the superimposed D.C. component leads to more rapid colouring. With the other electrolytes listed above, superimposed D.C. has little or no advantage and may indeed be disadvantageous.

In one arrangement in accordance with the present invention the superimposition of a D.C. component is very conveniently achieved in an apparatus in which both faces of the strip are anodised in a preceding D.C. continuous anodising stage.

The D.C. component is preferably of such a magnitude that the average current in the portion of the cycle when the strip is cathodic in the electrolytic colouring bath is 2–10 times, preferably 3–6 times, greater than the average current when the strip is anodic. The superimposed D.C. component may conveniently be derived from the rectifier system employed for the anodising stage, where the D.C. current is introduced into the strip in the anodising stage by means of longitudinally spaced cathodes and anodes, using the "liquid contact" technique.

We have described in U.S. Pat. No. 3,471,375 a method of continuously anodising aluminium strip, in which the strip whilst immersed in a turbulent stream of sulphuric acid electrolyte first passes one or more anodes to render cathodic that part of the surface facing the anodes and then passes a series of cathodes, longitudinally spaced from the anode or anodes, to render the facing surface anodic in relation to the cathodes. The arrangement described in that prior patent is very conveniently employed for the anodic oxidation stage in the present invention, when both faces of the strip are to be coloured. Conveniently the alternating current circuit for the electrolytic colouring is completed via the anodising cell anodes, since this results in a small portion of the direct current flowing from the counterelectrodes in the electrolytic colouring stage through the strip to the anodising cell cathodes.

Figure 2:
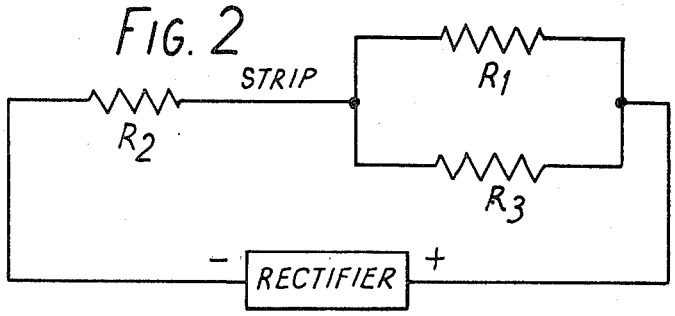
Figure 3:
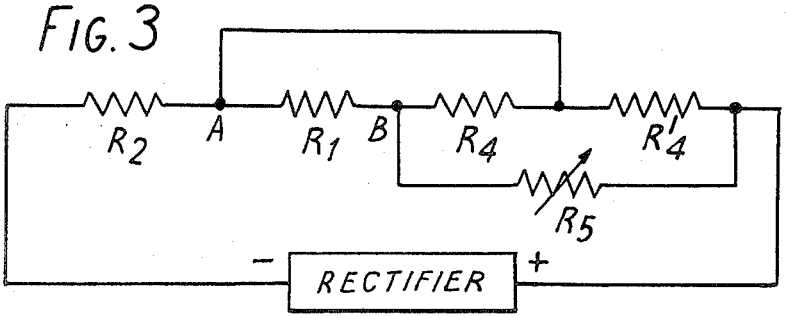
Figure 4:
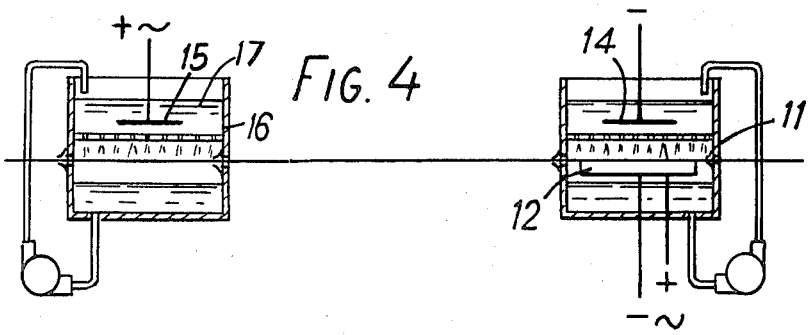
Figure 5:
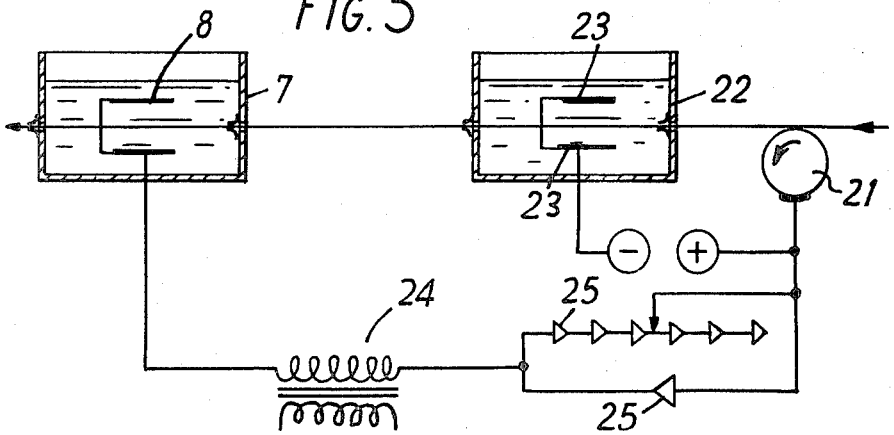

Referring now to the accompanying drawings:

FIG. 1 is a schematic arrangement of an apparatus for continuous production of anodised and coloured aluminium strip, FIG. 2 is a schematic of the D.C. circuit in FIG. 1, FIG. 3 is a schematic of the D.C. circuit of a modification of FIG. 1, FIG. 4 is a schematic arrangement for continuous anodising and colouring one surface of aluminium strip, and FIG. 5 is a schematic of an alternative arrangement for anodising and colouring both surfaces of an aluminium strip.

In FIG. 1 aluminium strip is drawn from a supply reel (not shown) into an anodising cell of the type described in U.S. Pat. No. 3,471,375, into which a stream of sulphuric acid electrolyte, for example 15% sulphuric acid, is supplied through inlets 2 and withdrawn through outlets 3 for recirculation. The cell 1 is shown as having five pairs of spaced electrodes 4. For performance of the anodising operation the first two pairs of electrodes 4 are connected to the positive of a rectifier assembly 5 and the remaining three pairs of electrodes 4 are connected to the negative. Other anodising electrolytes, such as oxalic acid or chromic acid, may be employed in the anodising cell in place of sulphuric acid.

After leaving the anodising stage the now anodised strip is passed through a rinsing stage, shown diagrammatically at 6, which serves to remove the sulphuric acid electrolyte. The strip then enters the electrolytic colouring cell 7 in which it passes between an array of counterelectrodes 8. The counterelectrodes 8 are connected to one terminal of a variable voltage A.C. supply 9, the other terminal of which is connected to the anode electrodes 4 in the cell 1, from which current flows to a substantially unanodised portion of the surface of the aluminium strip.

Considering FIG. 2, the resistances $R_1$, $R_2$, $R_3$ are the resistances of the current paths between the strip and the counterelectrodes 8, the strip and the cathodes 4, the strip and the anodes 4 respectively. Because of the growth of the anodic oxide film in the cell 1 and the lower conductivity of the electrolyte in the colouring stage (as compared with the anodising stage), $R_1 > R_2 > R_3$, and in consequence it will be seen that the D.C. current $i_1$ in the electrolytic colouring stage will be much smaller than the D.C. current employed in the anodising stage.

In one example the anodising cell 1 had a length of 12 feet and the colouring cell 7 had a length of 9 feet. The strip (2 inch wide) was drawn through at a speed of 12 ft./min. to give a dwell time of 1 minute in the anodising stage and 45 seconds in the colouring stage. Using a 15% sulphuric acid electrolyte at 60° C., a D.C. voltage of 25 volts was found to produce an anodic film of 5 microns thickness at a total current of 500 amps. It was found possible to provide a desirable dark bronze colour in this film with an A.C. current of 30 amps in 45 seconds dwell time in the cell 7, which contained the following nickel electrolyte:

$NiSO_4.7H_2O$: 25 gpl
$(NH_4)_2SO_4$: 15 gpl
$MgSO_4.7H_2O$: 20 gpl
$H_3BO_3$: 25 gpl
pH: 5.7

Alternatively other known baths, such as these containing salts of tin or cobalt, for electrolytic colouring of anodic aluminium oxide films by means of alternating current with superimposed direct current may be employed.

The counterelectrodes 8 were formed of lead strips and had a dimension in the direction of strip travel of two inches. In the system arranged as described above the ratio of the average cathodic current to the average anodic current in the cell 7 was estimated at about 4:1 by measuring the areas under the curve of oscillograms.

In the modified arrangement shown in FIG. 3, $R_1$ and $R_2$ have the same significance as in FIG. 2. $R_4$ and $R_4^1$ are respectively the resistance of the path between the strip and the first pair of electrodes 4 and between the strip and the second pair of electrodes 4. In this arrangement the variable resistance $R_5$ is connected in the conductor 10 in FIG. 1. As will be seen, this arrangement enables the D.C. current in the cell 7 to be varied by appropriate adjustment of resistor $R_5$. If conductor 10 is disconnected, the resistance $R_5$ becomes infinite and there is no D.C. component superimposed on the alternating current in the electrolytic colouring stage.

In another example the apparatus of FIG. 1 is operated with no interconnection between the two pairs of anodes 4 when employing a copper electrolyte in the electrocolouring stage. The anodisation was performed under the same conditions as in the preceding example, but no superimposed D.C. was employed in the electrolytic colouring stage. It was found possible to obtain a desirable maroon shade in this film with an A.C. current of 27 amps at 23 volts in 45 seconds dwell time with a copper-containing electrolyte having the following composition:

$CuSO_4.5H_2O$: 35 gpl
$MgSO_4.7H_2O$: 20 gpl
pH brought to 1.3 by addition of sulphuric acid.

One known system for anodising one surface of an aluminium strip is described in U.S. Pat. No. 3,296,114. An anodising cell 11 operating on that system is illustrated diagrammatically in FIG. 4. In the anodising cell 11 the reverse face of the strip is in contact with a carbon brush 12 connected to the positive terminal of a D.C. supply and a cathode 14 is connected to the negative terminal. The electrolyte is showered onto the strip through a perforated screen, the streams of electrolyte constituting the current path between the cathode 14 and the strip, which is brought into a somewhat curved profile during its passage through the cell so as to avoid much contact between the electrolyte and the reverse surface of the strip. The electrolytic colouring is carried out in a similar cell 16. The alternating current circuit for the electrolytic colouring operation is then completed between the electrode 12 and a counterelectrode 15 in the electrolytic colouring bath 17. It is preferable to superimpose a D.C. component on the current flowing in the A.C. circuit thus constituted, when an appropriate electrolyte is employed in the electrocolouring stage.

In an alternative arrangement a carbon electrode in contact with the unanodised side of the strip in the cell 16 may be employed in addition to the electrode 12. In this case the A.C. circuit is completed through this second carbon electrode. However the arrangement illustrated in FIG. 4 is preferred for reasons of economy since these carbon brushes become worn by contact with the strip and require periodic replacement.

FIG. 5 illustrates an arrangement for continuous anodisation and electrolytic colouring of aluminium strip where a contact roll is employed for introducing current into the strip in the anodisation stage. In this arrangement the contact roll 21 is connected to the positive terminal of a D.C. supply and cathodes 23 in an anodisation cell 22 are connected to the negative terminal. The roll 21, which is in contact with unanodised aluminium, is connected to one terminal of an A.C. supply having a superimposed D.C. component, whilst the opposite terminal is connected to the counterelectrodes 8 of the electrolytic colouring cell 7.

One means for generating A.C. with an asymmetrical waveform (equivalent to A.C. with a superimposed D.C. component) is shown in FIG. 5 and is comprised of a transformer 24 connected with diodes 25 as shown. Since there is a voltage drop of the order of 2 volts across each diode 25, more current can be caused to flow in the half cycle in which the strip is cathodic in cell 7 than in the half cycle in which it is anodic.

In some circumstances it may be desirable to operate the electrolytic colouring stage with pure D.C. current. In such case the A.C. component may be eliminated and the ratio of D.C. to A.C. becomes infinite.

We claim:

1. A method of producing a colored anodized aluminium strip which comprises drawing aluminium in strip form successively through an anodizing stage and an electrolytic coloring stage comprising in the anodizing stage moving the strip successively past one or more anodes immersed in a sulphuric acid anodizing electrolyte and past one or more cathodes and passing direct current between said cathodes and said anodes through the strip so as to render the strip initially cathodic and subsequently anodic to develop an anodic oxide film on the surface thereof, the thus anodized strip being then passed through, in said electrolytic coloring stage, an acidic electrolyte containing a material selected from a salt of at least one of copper, tin, cobalt, nickel, chromium, iron, silver or lead, or a manganate, tellurite or selenite, and passing alternating current between at least one electrode immersed in said acidic electrolyte and said anodized strip, the circuit for said alternating current being completed through an electrode immersed in the electrolyte of the direct current anodizing stage.

2. A method according to claim 1 in which a direct current component is superimposed on the alternating current in the electrolytic colouring stage.

3. A method according to claim 2 in which an alternating current source is connected between an anode of the anodising stage and the electrode in the electrolytic colouring stage whereby a direct current component is superimposed on the alternating current in the electrolytic colouring stage.

4. A method of producing a coloured anodised aluminium strip which comprises drawing aluminium in strip form successively through an anodising electrolyte and an acidic colouring electrolyte containing a material selected from a salt of at least one of copper, tin, cobalt, nickel, chromium, iron, silver or lead or a manganate, tellurite or selenite, passing direct current between said strip and at least one cathode immersed in said anodising electrolyte, direct current being introduced into said strip through an electrical contact at a location where said strip is substantially unanodised and passing alternating current between the anodised strip and at least one electrode immersed in the colouring electrolyte, the circuit for the alternating current being completed by contact with a substantially unanodised area of the surface of the aluminium strip to generate an asymmetric current wave form; the unanodised strip, before entry into the anodisation stage, being in contact with a contact roll connected to the positive terminal of said direct current supply and an alternating current source being connected between said contact roll and the electrode in the colouring electrolyte; diode branches in parallel being included in the connection between the contact roll and the colouring electrolyte electrode, the diodes in said branches being conductive in opposite directions, the voltage drops across said diode branches when conductive being unequal whereby to generate an asymmetrical alternating current.

5. A method of producing a coloured anodised aluminium strip which comprises drawing aluminium in strip form through an anodising stage, contacting the strip with a sulphuric acid electrolyte in said anodising stage, said strip being drawn successively past at least one anode electrode and at least one cathode electrode, a D.C. power source being established between said anode electrode and said cathode electrode whereby said strip in rendered initially cathodic and subsequently anodic during its passage through said anodising stage, advancing the thus anodised strip to and through an electrolytic colouring stage, contacting said strip with an acidic electrolyte containing a material selected from a salt of at least one of copper, tin, cobalt, nickel, chromium, iron, silver or lead or a manganate, tellurite or selenite and establishing an A.C. power source between said anode electrode in said anodising stage and a counterelectrode in contact with the electrolyte in the electrocolouring stage thereby to establish alternating current with a superimposed D.C. current component flowing between said anodised strip and said counterelectrode in the electrocolouring stage.

6. A method according to claim 5 in which said strip successively passes a first anode and a second anode longitudinally spaced from said first anode in the anodising stage, said anodes being connected in parallel to said A.C. power source, further including establishing a higher resistance path between said A.C. power source and said second anode than the path between said A.C. power source and said first anode.

7. A method of producing a coloured anodised aluminium strip which comprises drawing aluminium in strip form successively through an anodising electrolyte and an acidic colouring electrolyte containing a material selected from a salt of at least one of copper, tin, cobalt, nickel, chromium, iron, silver or lead or a manganate, tellurite or selenite, passing direct current between said strip and at least one cathode immersed in said anodising electrolyte, direct current being introduced into said strip through an electrical contact at a location where said strip is substantially unanodised and passing alternating current between the anodised strip and at least one electrode immersed in the colouring electrolyte, the circuit for the alternating current being completed by contact with a substantially unanodised area of the surface of the aluminium strip to generate an asymmetric current wave form; the alternating-current-passing step comprising passing alternating current through the strip between at least one electrode immersed in the colouring electrolyte and out of contact with said strip and at least one electrode immersed in the anodising electrolyte and facing a substantially unanodised area of said strip.

8. A process for electrolytically treating aluminum or its alloy in the form of a strip, wire or foil material in a continuous manner which comprises continuously passing the material through an anodic oxidation treatment cell and an electrolytic coloring cell to carry out electrolysis in said cells to anodize and color the material in a continuous manner, characterized in that just prior to the anodizing stage, a circuit is formed by commonly connecting to the aluminum material a power source for anodizing and a power source for electrolytically coloring, said power source for anodizing being further connected to the anodizing cell and said power source for electrolytically coloring being further connected to the electrolytic coloring cell; said power source for anodizing being DC and the power source for electrolytically coloring being AC, or the power source for both of them being a single AC-superimposed direct current, whereby a current having an alternating wave form rich in positive component is supplied to the electrode of the electrolytic coloring cell.

9. The process according to claim 8 wherein the electrolytic coloring is carried out in a solution containing a tin salt.

10. The process according to claim 8 wherein the electrolytic coloring is effected in a solution containing a tin salt and at least one member selected from the group consisting of nickel salts, cobalt salts, iron salts, and magnesium salts.

11. The process according to claim 8 wherein the electrolytic coloring is carried out in a solution containing at least one member selected from the group consisting of copper salts, selenium salts, and manganese salts.

12. The process according to claim 8 wherein a direct current voltage is applied between an electric power supply element outside the anodic oxidation treatment cell and an electrode plate within said cell and an alternating current voltage is applied between said element and an electrode plate within the electrolytic coloring cell.

13. A process according to claim 8, wherein the aluminum material is charged with a current having an alternating wave form rich in cathodic component in the electrolytic coloring cell.

14. A process for electrolytically treating aluminum or its alloy in the form of a continuous elongated material in a continuous manner which comprises continuously passing the material through an anodic oxidation treatment cell and an electrolytic coloring cell to carry out electrolysis in said cells to anodize and color the material in a continuous manner, characterized in that just prior to the anodizing stage, a circuit is formed by commonly connecting to the aluminum material a power source for anodizing and a power source for electrolytically coloring, said power source for anodizing being further connected to the anodizing cell and said power source for electrolytically coloring being further connected to the electrolytic coloring cell; said power source for anodizing being a current to anodize the aluminum material in the anodizing cell and said power source for electrolytically coloring being a current having an alternating wave form to color the aluminum material in the coloring cell.

15. The process according to claim 14 wherein the electrolytic coloring is carried out in a solution containing a tin salt.

16. The process according to claim 14 wherein the electrolytic coloring is effected in a solution containing a tin salt and at least one member selected from the group consisting of nickel salts, cobalt salts, iron salts, magnesium salts, copper salts, chromium salts, silver salts, lead salts, manganites, tellurites, and selenites.

17. The process according to claim 14 wherein the electrolytic coloring is carried out in a solution containing at least one member selected from the group consisting of copper salts, selenium salts, manganese salts, tin salts, cobalt salts, nickel salts, chromium salts, iron salts, silver salts, lead salts, and tellurites.

18. The process according to claim 14 wherein a direct current voltage is applied between an electric power supply element outside the anodic oxidation treatment cell and an electrode plate within said cell and an alternating current voltage is applied between said element and an electrode plate within the electrolytic coloring cell.

19. A process according to claim 14 wherein the aluminum material is charged with a current having an alternating wave form rich in cathodic component in the electrolytic coloring cell.

20. A process for electrolytically treating aluminum or its alloy in the form of a strip material in a continuous manner which comprises continuously passing the material through an anodic oxidation treatment cell and an electrolytic coloring cell to carry out electrolysis in said cells to anodize and color the material in a continuous manner, characterized in that just prior to the anodizing stage, a circuit is formed by commonly connecting to the aluminum material a power source for anodizing and a power source for electrolytically coloring, said power source for anodizing being further connected to the anodizing cell and said power source for electrolytically coloring being further connected to the electrolytic coloring cell; said power source for anodizing being DC and the power source for electrolytically coloring being AC, whereby a current having an alternating wave form rich in positive component is supplied to the electrode of the electrolytic coloring cell.

21. The process according to claim 20 wherein the electrolytic coloring is carried out in a solution containing a tin salt.

22. The process according to claim 20 wherein the electrolytic coloring is effected in a solution containing a tin salt and at least one member selected from the group consisting of nickel salts, cobalt salts, and iron salts.

23. The process according to claim 20 wherein the electrolytic coloring is carried out in a solution containing at least one member selected from the group consisting of copper salts, selenium salts, and manganese salts.

24. The process according to claim 20 wherein a direct current voltage is applied between an electric power supply element outside the anodic oxidation treatment cell and an electrode plate within said cell and an alternating current voltage is applied between said element and an electrode plate within the electrolytic coloring cell.

25. A process according to claim 20 wherein the aluminum material is charged with a current having an alternating wave form rich in cathodic component in the electrolytic coloring cell.

* * * * *